US006437749B2

(12) United States Patent
Nagayama et al.

(10) Patent No.: US 6,437,749 B2
(45) Date of Patent: Aug. 20, 2002

(54) GLASS ANTENNA FOR SIDE WINDSHIELD OF AUTOMOTIVE VEHICLE

(75) Inventors: Yoji Nagayama; Mitsuhisa Maegawa, both of Mie (JP)

(73) Assignee: Central Glass Company, Limited, Ube (JP)

( * ) Notice: Subject to any disclaimer, the term of this patent is extended or adjusted under 35 U.S.C. 154(b) by 0 days.

(21) Appl. No.: 09/725,100

(22) Filed: Nov. 29, 2000

(30) Foreign Application Priority Data

Dec. 9, 1999 (JP) ..... 11-349585

(51) Int. Cl.[7] ..... H01Q 1/32

(52) U.S. Cl. ..... 343/713; 343/711; 343/712; 343/897

(58) Field of Search ..... 343/711, 712, 343/713, 893, 897

(56) References Cited

U.S. PATENT DOCUMENTS

| | | | | |
|---|---|---|---|---|
| 4,749,998 A | * | 6/1988 | Yotsuya | 343/713 |
| 4,791,425 A | * | 12/1988 | Yotsuya et al. | 343/713 |
| 5,905,470 A | | 5/1999 | Fujii et al. | 343/713 |

FOREIGN PATENT DOCUMENTS

| | | |
|---|---|---|
| EP | 0 851 527 | 7/1998 |
| JP | 10-13127 | 1/1998 |
| JP | 10-65430 | 3/1998 |
| JP | 10-93317 | 4/1998 |
| JP | 10-303625 | 11/1998 |

* cited by examiner

*Primary Examiner*—Don Wong
*Assistant Examiner*—Shih-Chao Chen
(74) *Attorney, Agent, or Firm*—Crowell & Moring LLP

(57) ABSTRACT

In a glass antenna for a windshield such as a side windshield located at either side of a passenger compartment of an automotive vehicle, a feed terminal is disposed on a proximity to a first corner of the windshield, a substantially letters shaped antenna element comprising: a first wire segment (3*a*, 3*b*, 3*a*') extended from the feed terminal at the proximity to the first corner toward a substantially opposite direction to the first corner along at least a first side edge of the windshield, a second wire segment (3*c*) is extended from a tip of the first wire segment toward a proximity to a center of a second side edge of the windshield, a third wire segment (3*d*) is extended from a tip of the second wire segment toward a proximity to a second corner of the windshield which is opposite to the first corner, a fourth wire segment (3*e*) is extended from a tip of the third wire segment toward a substantially opposite direction to the second corner along a third edge of the windshield, and a plurality of other antenna elements are connected to the feed terminal and extended in parallel to one another in a first space defined between the first and second wire segments of the letters shaped antenna element and in a second space defined between the second, third, and fourth wire segments thereof.

18 Claims, 8 Drawing Sheets

GLASS ANTENNA FOR SIDE WINDSHIELD OF AUTOMOTIVE VEHICLE

BACKGROUND OF THE INVENTION

1. Field of the Invention

The present invention relates to a glass antenna for a windshield of an automotive vehicle, particularly, for a side windshield (also called, a side window glass) of the vehicle, the glass antenna being especially suitable for receiving electromagnetic waves of both FM (Frequency Modulation) broadcasting waves and AM (Amplitude Modulation) broadcasting waves.

2. Description of the Related Art

Examples of glass antennas for automotive vehicles having heretofore known and put into practice are an antenna attached to a marginal area or space of a rear window glass (a rear windshield) above or below a defogger electric heating element and an antenna including a conductive strip provided to a front window glass (a front windshield).

The former antenna, however, is not always capable of attaining a sufficient reception gain since the space occupied by the antenna is required to be small for eliminating a possibility that the antenna makes poor a visibility (a field of view).

The latter antenna, namely, the antenna provided to the front windshield can attain a relatively high reception gain but is encountered by a larger restriction on its attaining place than the rear windshield so that it never blocks driver's visibility (driver's field of view).

Various types of glass antennas attached onto the side window glass (hereinafter, referred to the side windshield) have been proposed since no such a restriction as described above has been placed on the side windshield and a recreational vehicle (RV car) has come to be widely used on which each side windshield, each side windshield having a relatively wide area, is attached.

A Japanese Patent Application First Publication No. Heisei 10-93317 published on Apr. 10, 1998 exemplifies a first previously proposed AM-and-FM frequency band receivable glass antenna for the side windshield.

In the first previously proposed glass antenna, a first antenna element is arranged along a proximity to a whole window frame edge, a feed terminal for the antenna elements is arranged on a proximity to one corner of the side windshield, and five or more horizontally extended antenna elements are arranged at an equal spatial interval of 5 millimeters or longer.

A Japanese Patent Application First Publication No. Heisei 10-303625 published on Nov. 13, 1998 exemplifies a second previously proposed AM broadcasting, FM broadcasting, and television broadcasting wave receivable glass antenna.

The second previously proposed glass antenna includes a first antenna conductor, a second antenna conductor, a third antenna conductor, a first feed terminal, and a second feed terminal. The first antenna conductor connected to the second feed terminal includes a plurality of antenna elements extended approximately in parallel to one another, one end of each of the antenna elements being connected to a corresponding one end of the others of the antenna elements. The second antenna conductor is extended from the first feed terminal, is of a semi-circular antenna element enclosing a surrounding of the first antenna conductor, and is electrically connected to at least one of the plurality of antenna elements of the first conductor.

In addition, a Japanese Patent Application First Publication No. Heisei 10-65430 published on Mar. 16, 1998 exemplifies a third previously proposed vehicular glass antenna.

In the third previously proposed vehicular glass antenna, a feed terminal and a loop-shaped or semi-loop shaped main antenna conductor connected to the feed terminal are attached onto a vehicular window glass plate. A sub-antenna conductor is added to at least one of either upper or lower loop-shaped main antenna conductor, is extended in an approximately longitudinal direction of the glass plate, and is extended approximately in parallel to the main antenna conductor.

Furthermore, a Japanese Patent Application First Publication No. Heisei 10-13127 published on Jan. 16, 1998 exemplifies a fourth previously proposed vehicular glass antenna suitable for receiving AM radio broadcasting waves and FM radio broadcasting waves.

The fourth previously proposed vehicular glass antenna includes: a first horizontal wire segment extended from a feed terminal disposed on one corner of the vehicular side windshield plate along a lower side edge or an upper side edge; a first vertical wire segment extended from a tip of the first horizontal wire segment toward an approximately center of one side edge; a second horizontal wire segment extended horizontally from a tip of the first vertical wire segment toward an approximately center of the other side edge; a second vertical wire segment extended from a tip of the second horizontal wire segment to either an upper side or lower side which is opposite to the first horizontal wire segment; and a third horizontal wire segment extended from a tip of the second vertical wire segment along either the upper or lower side edge which is opposite to the first horizontal wire segment.

SUMMARY OF THE INVENTION

There are many RV cars whose rear windshield plate can be opened or closed. Since such a coaxial cable wired from the antenna attached to the rear windshield plate of each RV car described above is repeated to be bent due to a repetitive open or closure of the rear windshield plate, the repetitive bending of the coaxial cable tends to provide a cause of a failure such as a wire breakage or imperfect contact in the glass antenna.

In addition, since, even in the case of the RV cars whose rear windshield plates cannot be opened nor closed, a dimension of the rear windshield plate of each RV car described above is rather small and an assembly angle of the antenna to the windshield is almost near to a right angle and the occupied area of the glass antenna at the marginal area upper or lower than the defogging heating wire segments becomes narrow.

If the antenna elements are attached onto such a marginal area or space as described above, the glass antenna cannot obtain a sufficient reception gain. This is remarkable in a case of the antenna elements by which the AM radio broadcasting waves having low reception frequencies and FM radio broadcasting waves are received.

Recently, a radio broadcasting wave receiving antenna attached onto the side windshield of the vehicle has been demanded.

A directivity of the glass antenna attached onto one side windshield located at a driver's seat side or at the same directional rearward side of the vehicle is different in a reception gain from that located at a passenger's seat side or at the same directional rearward side of the vehicle. There is a antenna arranged direction in which the directivity is low. That is to say, in a case where the glass antenna is attached onto the side windshield located at the driver's seat side, a favorable reception state can be obtained for the electromagnetic waves arriving at the vehicle from an upper sky viewed from the driver's seat side. However, a sufficient reception gain is difficult to be obtained for the electromagnetic waves arriving at the passenger's seat side.

In addition, each of the first, second, and third previously proposed vehicular glass antennas disclosed in the above-described Japanese Patent Application First Publications No. Heisei 10-93317, Heisei 10-303625, and Heisei 10-65430 is attached onto the side windshield and has a relatively small area. Although a reception sensitivity on the AM radio broadcasting waves is favorable, the reception sensitivity of the FM radio broadcasting waves is not sufficient.

Furthermore, the fourth previously proposed vehicular glass antenna for the side windshield disclosed in the Japanese Patent Application First Publication No.

Heisei 10-13127 is used mainly for the reception of the FM radio broadcasting waves, Although it is possible to receive the AM radio broadcasting waves, the reception sensitivity is rather insufficient. The area of the glass plate cannot help being widened.

It is therefore an object of the present invention to provide a non-directivity glass antenna for a side windshield of an automotive in which antenna elements which are capable of receiving AM radio broadcasting waves with a high reception sensitivity in addition to being capable of receiving FM radio receiving broadcasting waves with a superior directivity characteristic are effectively disposed on the side windshield.

The above-described object can be achieved by providing a glass antenna for a windshield for an automotive vehicle, comprising: a feed terminal disposed on a proximity to a first corner of the windshield; a substantially letter-S shaped antenna element comprising: a first wire segment extended from the feed terminal at the proximity to the first corner toward a substantially opposite direction to the first corner along at least a first side edge of the windshield; a second wire segment extended from a tip of the first wire segment toward a proximity to a center of a second side edge of the windshield; a third wire segment extended from a tip of the second wire segment toward a proximity to a second corner of the windshield which is opposite to the first corner; and a fourth wire segment extended from a tip of the third wire segment toward a substantially opposite direction to the second corner along a third edge of the windshield; and a plurality of other antenna elements, the other antenna elements being connected to the feed terminal and extended in parallel to one another in a first space defined between the first and second wire segments and in a second space defined between the second, third, and fourth wire segments.

The above-described object can also be achieved by providing a glass antenna for a side windshield of an automotive vehicle, the side windshield comprising a general shape of a parallelogram and the glass antenna comprising: a feed terminal disposed on a proximity to a first corner of the side windshield; a substantially letter-S shaped antenna element comprising: a first horizontal wire segment extended from the feed terminal toward a horizontally opposite direction to the first corner along a first side edge of the side windshield; a first vertical wire segment extended from a tip of the first horizontal wire segment toward a proximity to a center of a second side edge of the side windshield; a second horizontal wire segment extended horizontally from a tip of the first vertical wire segment toward a proximity to a center of a third side edge of the side windshield which is opposite to the proximity to the center of the first side edge thereof; a second vertical wire segment extended vertically from a tip of the second horizontal wire segment toward a proximity to a second corner of the side windshield; and a third horizontal wire segment extended from a tip of the second vertical wire segment toward a proximity to a third corner of the side windshield; and a plurality of other antenna horizontal elements connected to the feed terminal and extended in parallel to one another in a first space defined between the first horizontal and first vertical wire segments and the second horizontal wire segment and in a second space defined between the second horizontal, the second vertical, and the third horizontal wire segments.

The above-described object can also be achieved by providing a glass antenna for a side windshield of an automotive vehicle, the side windshield comprising a general shape of a right triangle and the glass antenna comprising: a feed terminal disposed on a proximity to a first corner of the side windshield; a substantially letter-S shaped antenna element comprising: a first arc-shaped wire segment extended from the feed terminal toward a substantially horizontally opposite direction to the first corner along a side edge faced toward a body flange and toward a proximity to a center of the side edge; a second horizontal wire segment extended horizontally from a tip of the arc-shaped wire segment toward a proximity to a center of another side edge of the side windshield which is opposite to the proximity to the body flange; and a second vertical wire segment extended vertically from a tip of the second horizontal wire segment toward a proximity to a second corner of the side windshield; and a third horizontal wire segment extended from a tip of the second vertical wire segment toward a substantially opposite direction to the second corner of the side windshield; and a plurality of other antenna horizontal elements connected to the feed terminal and extended in parallel to one another in a first space defined between the first arc-shaped and second horizontal wire segments and in a second space defined between the second horizontal wire segment, the second vertical wire segment, and the third horizontal wire segment.

DETAILED DESCRIPTION OF THE PREFERRED EMBODIMENTS

Reference will hereinafter be made to the drawings in order to facilitate a better understanding of the present invention.

Figure 1:
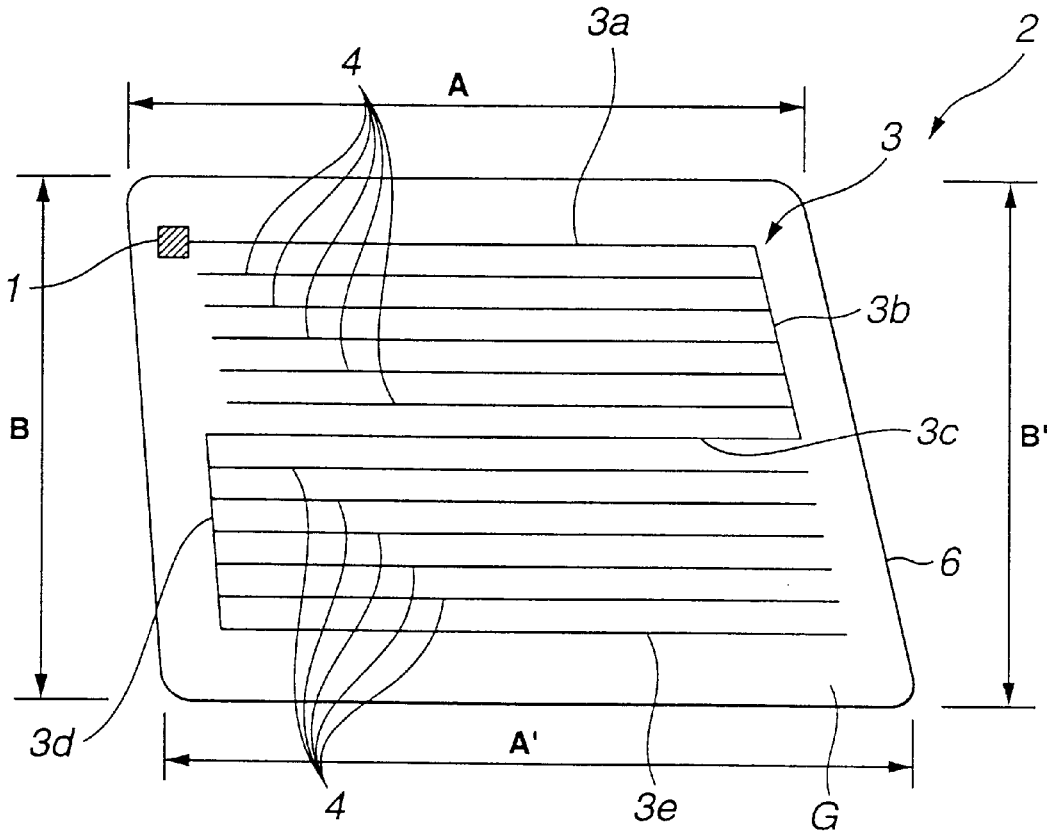
FIG. 1 is an elevation view of a side windshield onto which a basic pattern of antenna elements in the case of a first preferred embodiment of a glass antenna according to the present invention is attached, as viewed from a passenger compartment of an automotive vehicle.

FIG. 1 shows a glass antenna for a side windshield of an automotive vehicle in a first preferred embodiment according to the present invention.

Namely, a basic antenna element arrangement pattern of the glass antenna 2 is shown in FIG. 1.

As shown in FIG. 1, a feed terminal (or feed point) 1 is attached on a proximity to a corner of the side window glass plate (namely, the side windshield) G.

In details, the glass antenna 2 in the first embodiment includes: a first horizontal wire segment 3*a* extended from the feed terminal 1 along either an upper or lower side edge of a body flange 6; a first vertical wire segment 3*b* extended from a tip of the first horizontal wire segment 3*a* along one of longitudinal side edges toward a proximity to a center of the one longitudinal side edge; a second horizontal wire segment 3*c* folded toward a horizontal direction from the tip of the first vertical wire segment 3*b*; a second vertical wire segment 3*d* extended from a tip of the second horizontal wire segment 3*c* along the other of the longitudinal side edges; and a third horizontal side edges; and a third horizontal wire segment 3*e* extended from a tip of the second vertical wire segment 3*d* along either an upper or lower side edge which is vertically opposite to the first horizontal wire segment 3*a*. In addition, a plurality of horizontal antenna elements 4, 4, 4, 4, - - - extended horizontally in parallel to one another at equal spatial intervals in a first space defined between the first horizontal wire segment 3*a*, the first vertical wire segment 3*b*, and in a space defined between the second horizontal wire segment 3*c*, the second vertical wire segment 3*d*, and the third horizontal wire segment 3*e*, respectively. The substantially letter-S shaped antenna element 3 and the horizontal antenna elements 4, 4, 4, - - - are a basic configuration of the glass antenna 2 according to the present invention.

It is noted that each wire segment 3*a*, 3*b*, 3*c*, and 3*d* disposed along a surrounding of the (vehicle) body flange 6 is preferably separated from an inner edge of the body flange 6 by ten millimeters at shortest or longer in order not to reduce a reception gain due to an influence from a metal body.

Figure 2:
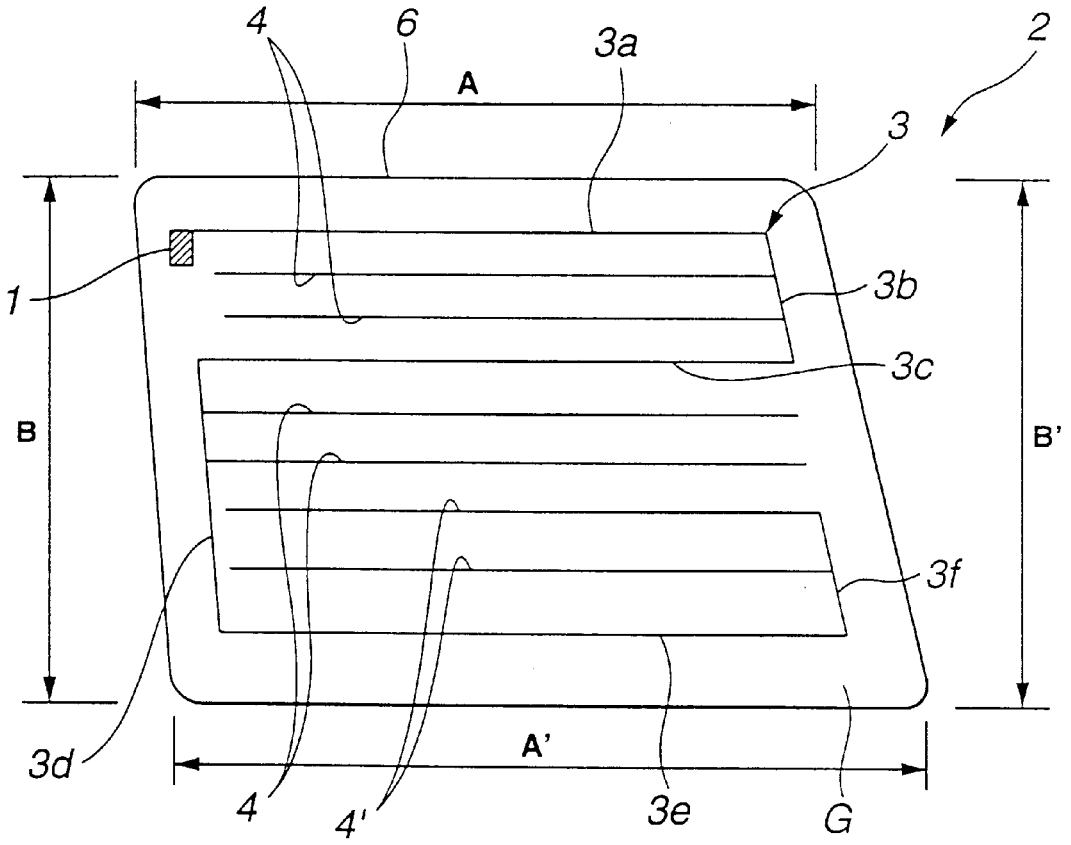
FIG. 2 is an elevation view of the side windshield onto which a basic pattern of antenna elements is attached in the case of a second preferred embodiment of the glass antenna according to the present invention, as viewed from the passenger compartment.

FIG. 2 shows a second preferred embodiment of the glass antenna 2 for the side windshield G according to the present invention.

In the second embodiment shown in FIG. 2, a third vertical wire segment 3*f* is additionally extended from a tip of the third horizontal wire segment 3*e* toward the first vertical wire segment 3*b*. The third vertical wire segment 3*f* is extended to a midway through a proximity to the center of the one longitudinal side edge of the body flange 6.

In addition, the plurality of horizontal elements 4' and 4' are connected to the feed terminal 1 via a tip and a half midway point of the third vertical wire segment 3*f* and extended horizontally up to a proximity to the second vertical wire segment 3*d* in the second space.

Figure 3:
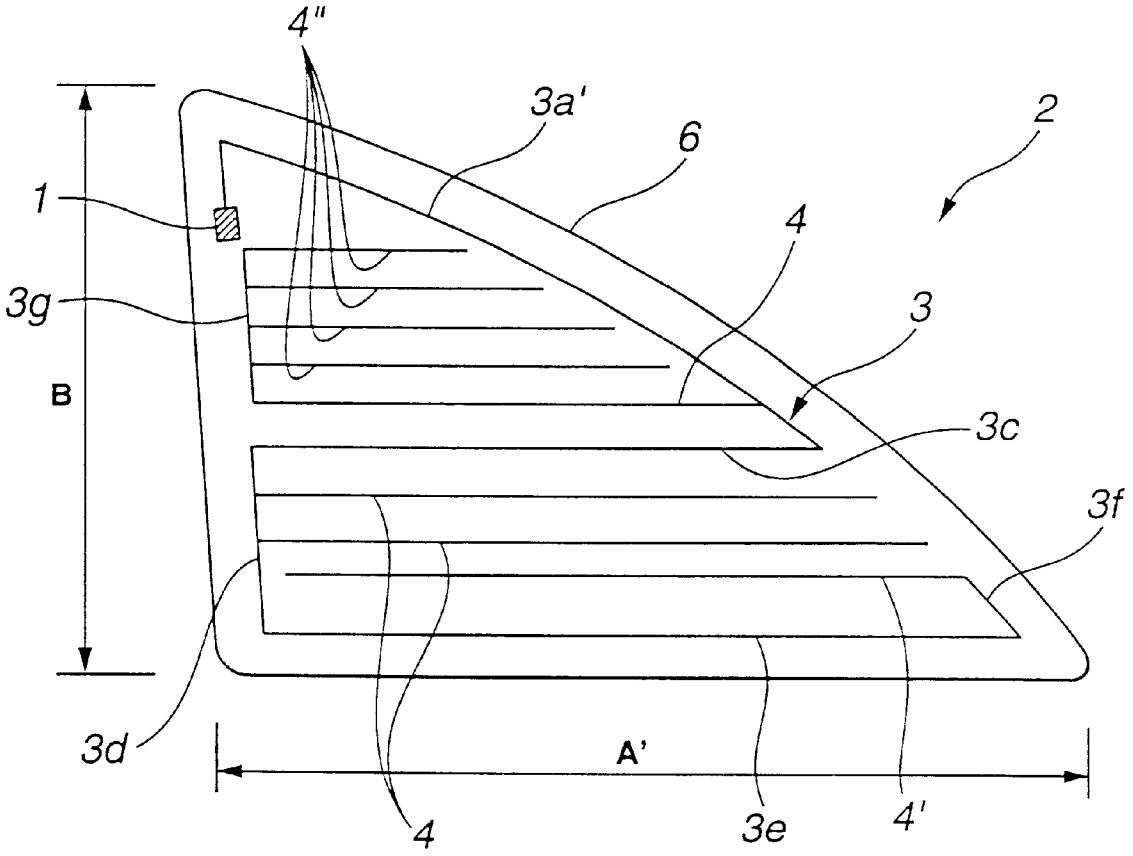
FIG. 3 is an elevation view of the side windshield onto which an antenna element pattern of the glass antenna in a case of a third preferred embodiment according to the present invention is attached, as viewed from the passenger compartment.

FIG. 3 shows a third preferred embodiment of the glass antenna for the side windshield according to the present invention.

The glass antenna 2 shown in FIG. 3 is a variation of the basic antenna element pattern shown in FIG. 1.

A shape of a sheet of the side window glass (side windwhield) G is a substantially right triangle (the shape of the sheet of the window glass shown in FIGS. 1 and 2 is a substantially parallelogram).

In the third embodiment of the glass antenna 2, a substantially arc-shaped wire segment 3*a'* extended from the feed terminal 1along an inner edge of the body flange 6 corresponds to the first horizontal wire segment 3*a* and the first vertical wire segment 3*b* in the case of each of the first and second embodiments shown in FIGS. 1 and 2.

As shown in FIG. 3, a fourth vertical wire segment 3*g* is extended vertically from a tip of one of the plurality of the other horizontal antenna elements 4, 4, - - - which is extended horizontally from a second lowest point of the arc-shaped wire segment 3*a'* toward a proximity to the feed terminal 1. Then, a plurality of other horizontal antenna elements 4", 4" are extended in parallel to one another in the first space defined between the arc-shaped wire segment 3*a'* and the one of the plurality of other horizontal antenna elements 4 and are connected to the feed terminal 1 via the fourth vertical wire segment 3*g*.

The other horizontal antenna elements 4" and 4" are extended up to a proximity to the arc-shaped wire segment 3*a'*.

Furthermore, a third vertical wire segment 3*f* is additionally extended from the tip of the third horizontal wire segment 3*f* toward the arc-shaped wire segment 3*a'*.

One of the other antenna elements 4'. is extended horizontally from the tip of the third vertical wire segment 3*f* toward a proximity to the second vertical wire segment 3*d*.

It is noted that since in a case where the feed terminal 1 is placed at a corner of lower side of the side windshield, the shape of the whole glass antenna 2 is an up-side down (inverted) letter-S shape, the wire segment including the second vertical wire segment 3*d* and the third horizontal segment 3*e* may be of the arc-shape wire segment extended along the body flange 6 to match with the shape of the body flange 6.

The glass antenna 2 according to the present invention can provide an improved directivity for the FM radio frequency broadcasting waves through its substantially letter-S shaped antenna element pattern 3 so that a reception gain for the electromagnetic waves in every direction arriving at the glass antenna 2 can more highly be augmented.

In addition, the plurality of other horizontal antenna elements 4, - - - , 40 , - - - , and 4", - - - from the tips or midpoints of the respective vertical wire segments 3*b* , 3*d*, 3*f*, and 3*g* can provide a favorable reception capability of the AM radio broadcasting waves.

Since for the horizontal antenna elements 4, - - - , 4', - - - , and 4", - - - , the reception gain of the antenna, and a reception effective area can be enhanced in accordance with the number of the horizontal elements and a high-gain wave reception performance can be obtained even though a glass sheet area is relatively small.

Figure 4:
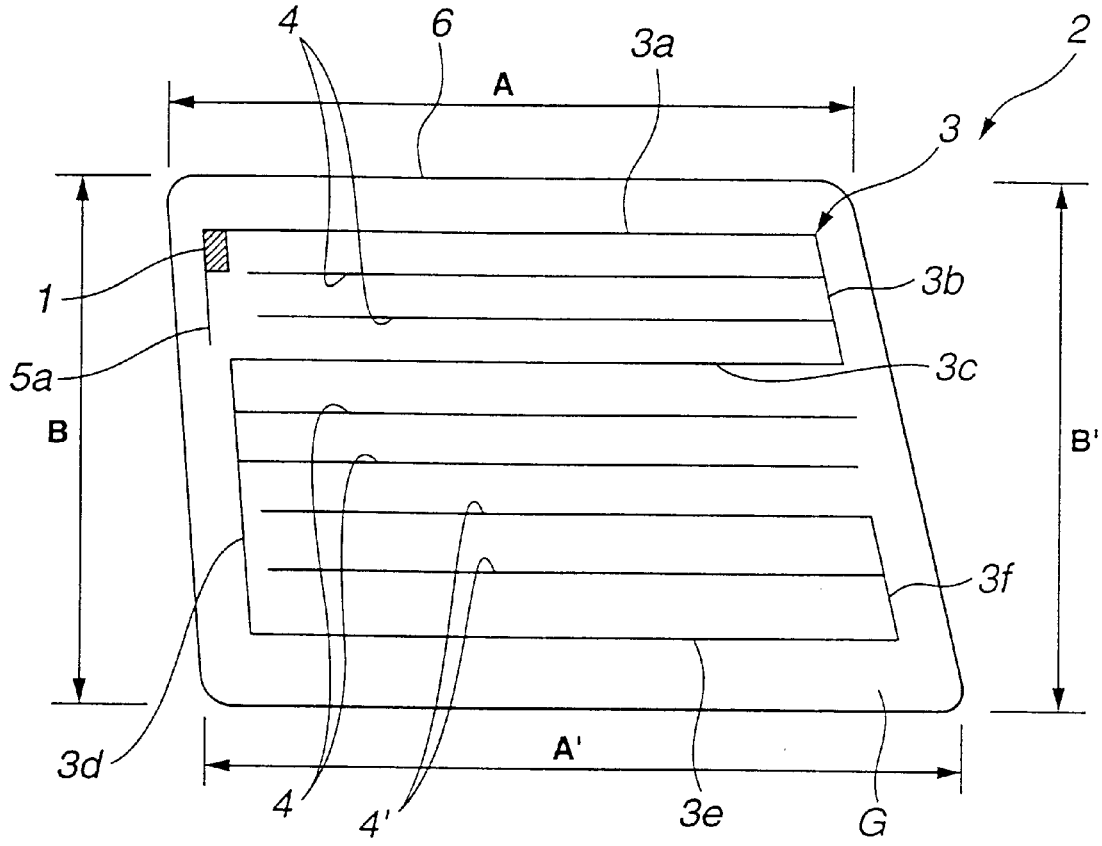
FIG. 4 is an elevation view of the side windshield onto which the antenna pattern of the glass antenna in a case of the second preferred embodiment shown in FIG. 2 to which a first auxiliary antenna element is added.

FIG. 4 shows a fourth preferred embodiment of the glass antenna 2 in which a first auxiliary antenna element 5*a* is extended from the feed terminal 1 in a anti-counterclockwise direction along the body flange 6 and the other arrangement pattern is the same as the second embodiment shown in FIG. 2.

Figure 5:
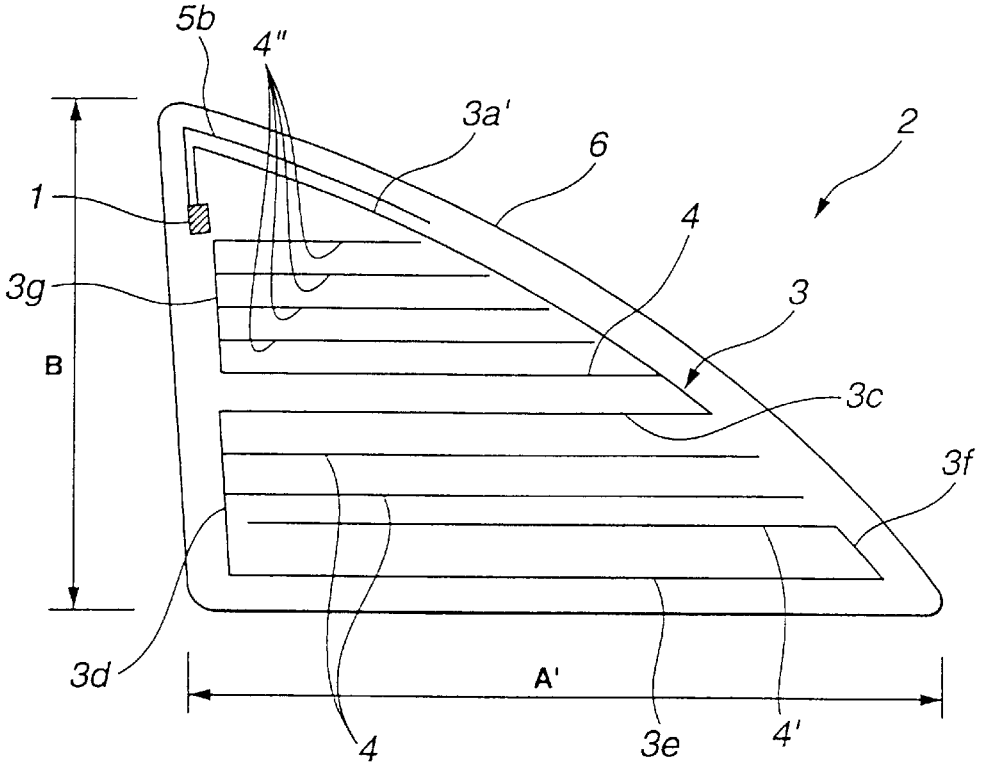
FIG. 5 is an elevation view of the side windshield onto which the antenna pattern of the glass antenna in the case of the third preferred embodiment shown in FIG. 3 to which a second auxiliary antenna element is added.

FIG. 5 shows a fifth preferred embodiment of the glass antenna 2 in which a second auxiliary antenna element 5*b* is extended from the feed terminal 1 in a counterclockwise direction along the body flange 6 and the other arrangement pattern is the same as the third embodiment shown in FIG. 3.

The first or second auxiliary antenna element 5*a* or 5*b* is added in the glass antenna 2 shown in FIG. 2 or 3 in order to improve an impedance characteristic, the directivity, or frequency characteristic of the antenna especially in the FM radio broadcasting band.

In addition, the glass antenna 2 according to the present invention is disposed on the side windshield plate G at either left or right side of the vehicle body to receive solely the AM radio broadcasting wave or the FM radio broadcasting wave. However, it is preferable that the glass antenna 2 according to the present invention may be combined to the glass antenna installed on the other side of the windshield (the glass antenna 2 according to the present invention may be used or any other type of the glass antenna for receiving the FM radio broadcasting wave may be used), the glass antenna installed on the rear windshield, or that installed on the front windshield to achieve a diversity reception in order to receive each of the FM radio broadcasting waves.

It is noted that the substantially letter-S shaped antenna element can be interpreted as the antenna element including the vertically inverted or horizontally inverted letter-S shaped antenna element.

Next, the detailed description of examples and advantages of the glass antenna 2 according to the present invention will hereinafter be made with reference to the drawings.

Described hereinbelow will be examples of the glass antenna 2 in each of the first, second, and third embodiments installed on a surface of the side window sheet attached onto a wide window frame and faced toward the passenger compartment together with the feed terminal 1.

FIGS. 1 through 3 are elevation views of the antenna element patterns in each of the first, second, and third embodiments arranged onto the side windshield, each being a drawing viewed from the passenger compartment.

Figure 6:
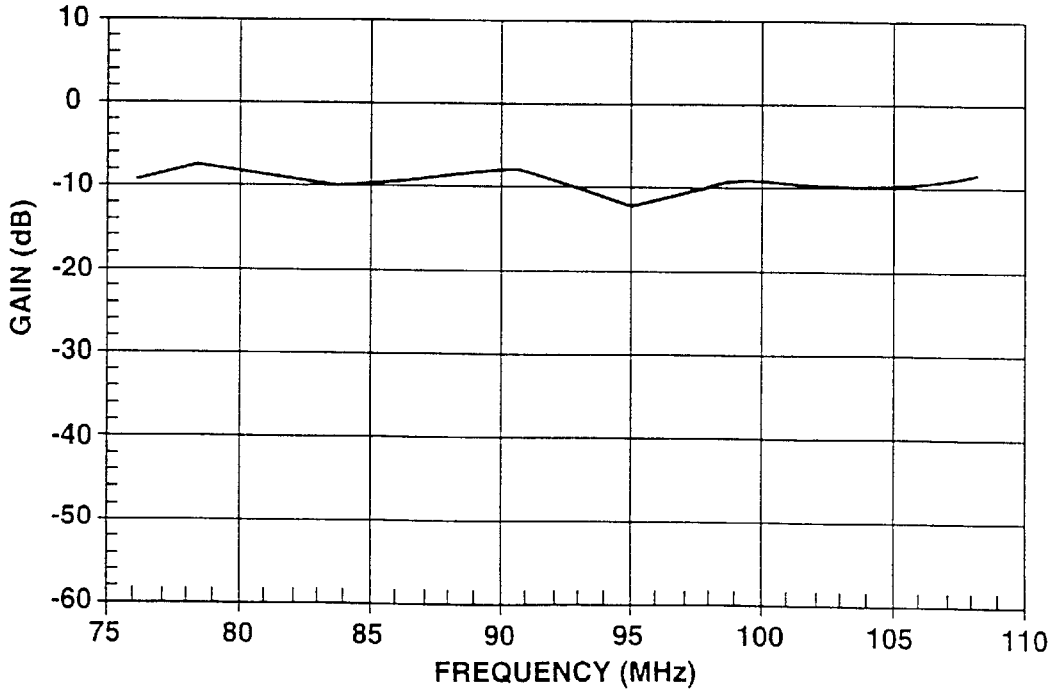
FIG. 6 is a characteristic graph representing a frequency characteristic of the glass antenna shown in FIG. 1 when an electromagnetic wave of an FM radio frequency band is received by the glass antenna in the first embodiment.
Figure 7:
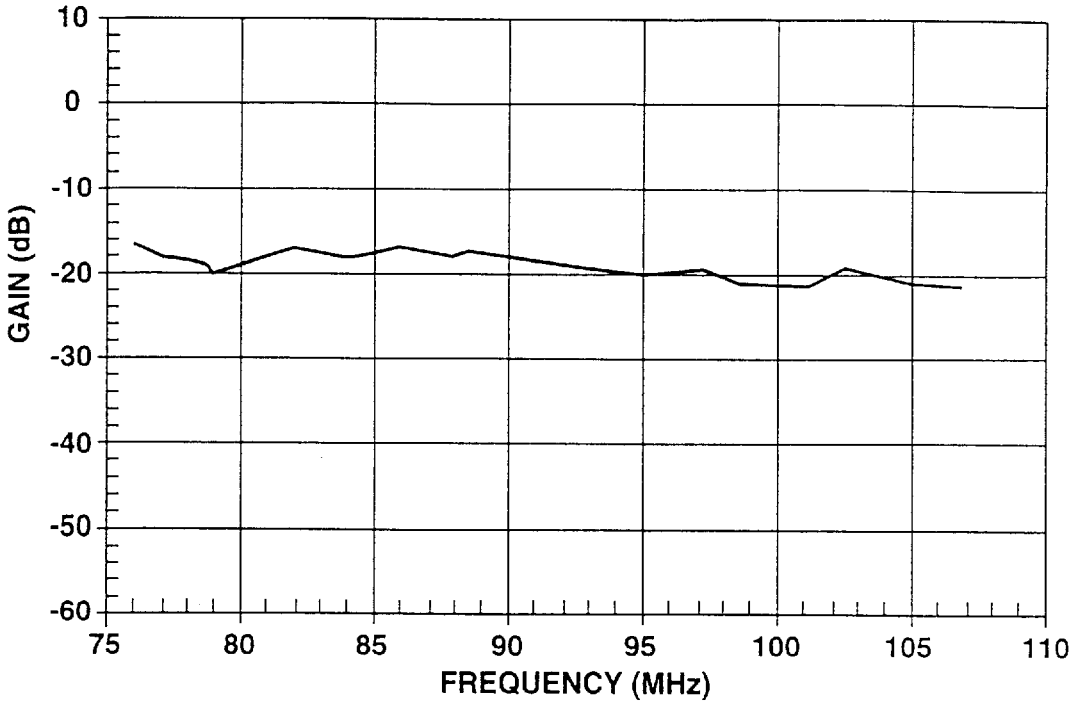
FIG. 7 is a characteristic graph representing a frequency characteristic of the glass antenna shown in FIG. 2 when the electromagnetic wave of the FM radio frequency band is received by the glass antenna in the second embodiment shown in FIG. 2.
Figure 8:
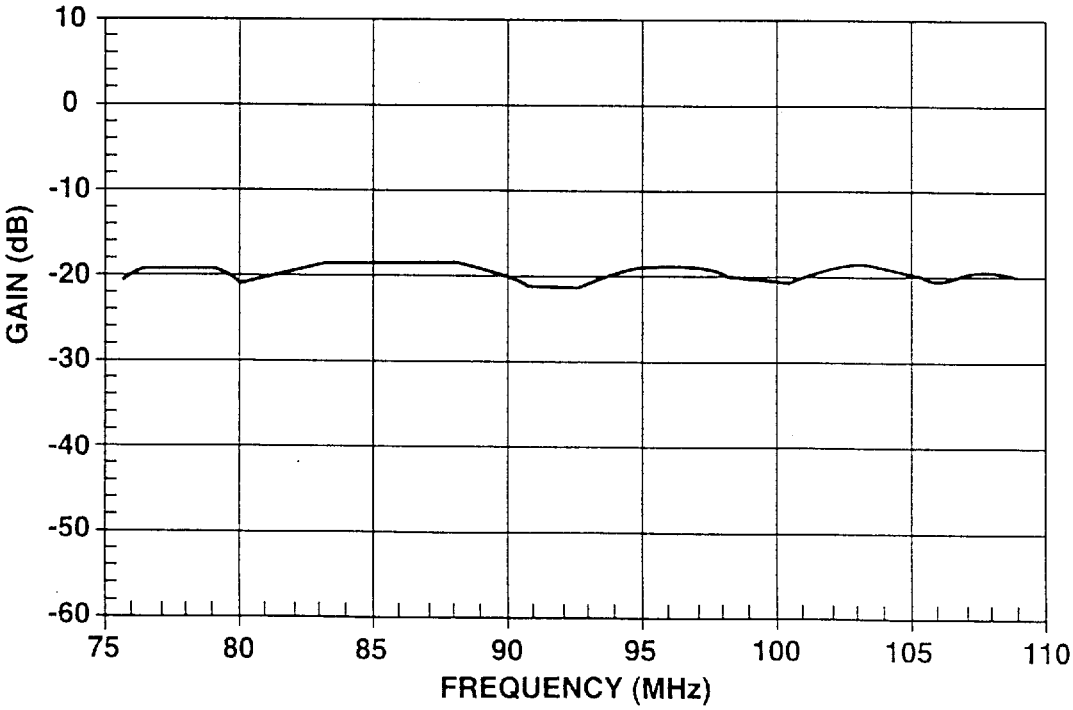
FIG. 8 is a characteristic graph representing a frequency characteristic of the glass antenna when the electromagnetic wave of the FM radio frequency band is received by the glass antenna pattern in the third embodiment shown in FIG. 3.

FIGS. 6, 7, and 8 are frequency characteristic graphs of the respective antenna arrangement patterns in the first, second, and third embodiments when each of them received the waves of an FM radio frequency band.

Figure 9:
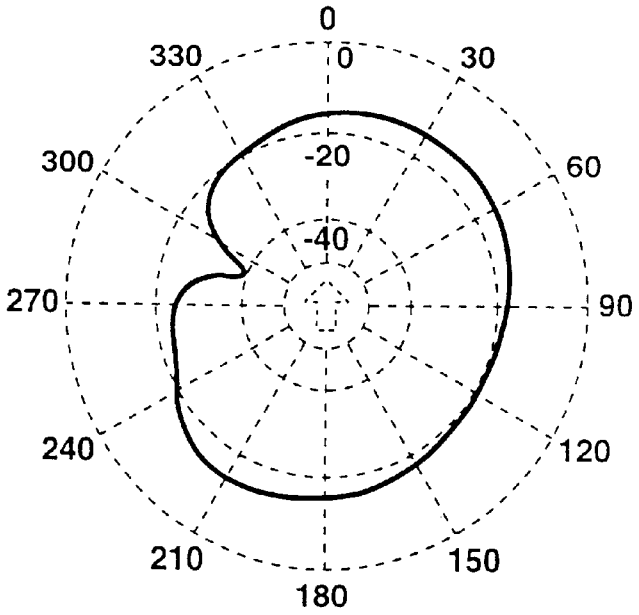
FIG. 9 is a characteristic graph representing a directivity characteristic of the glass antenna when the electromagnetic wave of the FM radio frequency band is received by the basic pattern of the glass antenna in the first embodiment shown in FIG. 1.
Figure 10:
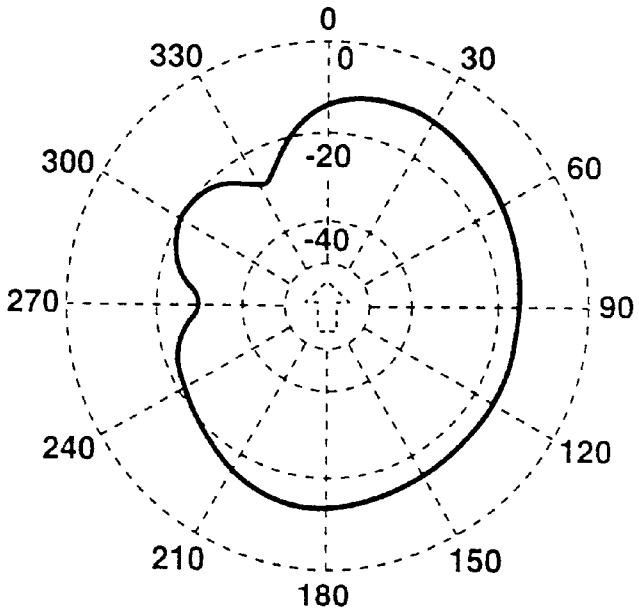
FIG. 10 is a characteristic graph representing a directivity characteristic when the electromagnetic wave in the FM radio frequency band is received by the basic antenna pattern in the second embodiment shown in FIG. 2.
Figure 11:
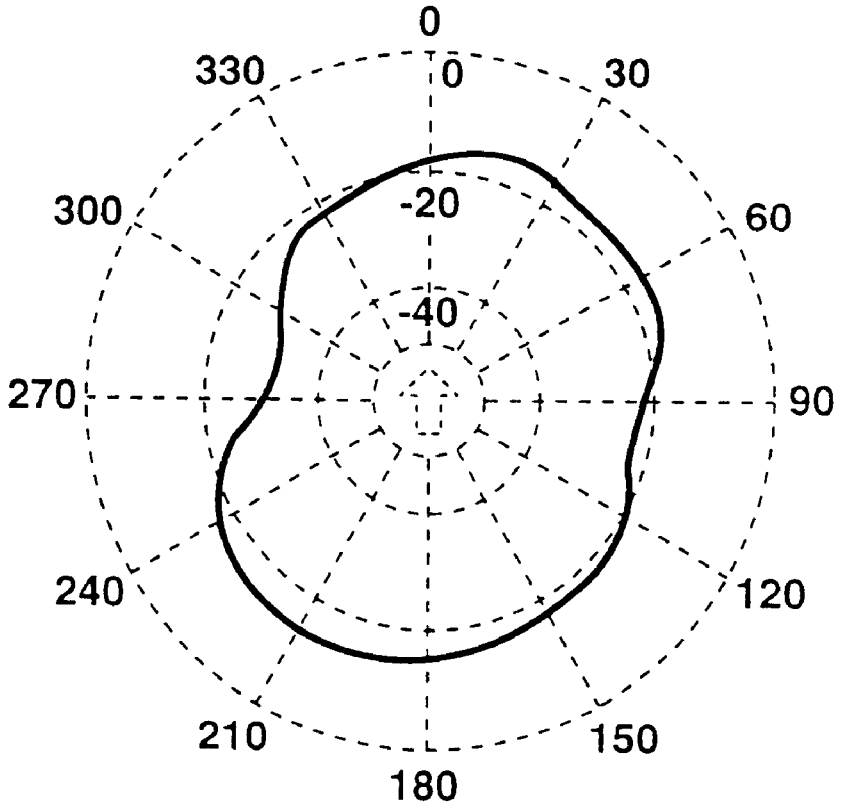
FIG. 11 is a characteristic graph representing a directivity characteristic when the electromagnetic wave in the FM radio band is received by the basic antenna pattern in the third embodiment shown in FIG. 3.

FIGS. 9, 10, and 11 are directivity characteristic graphs of the respective antenna arrangement patterns in the first, second, and third embodiments when each of them received the waves of the FM radio frequency band.

Table 1 is a table representing a wave reception gain of an AM radio frequency band when the respective horizontal antenna elements are added to the letter-S shaped antenna element of the basic pattern of the first embodiment shown in FIG. 1.

First Embodiment

As shown in FIG. 1, the letter-S shaped glass antenna 2 includes: the letter-S shaped antenna element 3 having the first horizontal wire segment 3*a* extended from the feed terminal 1attached onto the left uppermost corner of the side window glass G of the vehicle along the upper side edge of the body flange 6; the first vertical wire segment 3*b* extended from the tip of the first horizontal wire segment 3*a* along the right longitudinal side edge up to approximately center of the right longitudinal side edge; the second horizontal wire segment 3*c* horizontally folded in the horizontal direction from its tip of the first vertical wire segment 3*b*, the second vertical wire segment 3*d* extended in the downward direction from the tip of the second horizontal wire segment 3*c* along the left longitudinal side edge; and the third horizontal wire segment 3*e* extended along the lower side edge and the five horizontal antenna elements 4, 4, 4, - - - extended from the first vertical wire segment 3*b* and the second vertical wire segment 3*d* toward opposing longitudinal side edges. This glass antenna 2 shown in FIG. 1 was printed in a screen printing using a conductive material such as a silver paste having a wire width of 0.5 millimeter to 1millimeter before a bending process and was formed by a sintering process at the same time of the ben ding process.

A length of each conductive wire segment in the first embodiment was as follows:

A length of the first horizontal wire segment 3*a* of the letter-S shaped antenna element=450 mm.

A length of the first vertical wire segment 3*b* of the letter-S shaped antenna element=210 mm.

A length of the second horizontal wire segment 3*c* of the letter-S shaped antenna element=475 mm.

A length of the second vertical wire segment 3*d* of the letter-S shaped antenna element=210 mm.

A length of the third horizontal wire segment 3*e* of the letter-S shaped antenna element=500 mm.

The length of each horizontal antenna element 4, - - - =450 through 500 millimeters.

An interval between each horizontal antenna element 4, - - - =35 mm.

An interval between one of the horizontal antenna elements 4 and the first horizontal wire segment 3*a* , between one of the horizontal antenna elements 4 and the second horizontal wire segment 3*c*, and between one of the horizontal antenna elements 4 and the third horizontal wire segments 3*e*=35 mm.

A dimension of the inner side edge of the body flange 6 thus obtained was upper side A=50 mm, lower side A'=550 mm, left longitudinal side B as viewed from the passenger compartment=450 mm, as right longitudinal side B'=450 mm.

The frequency characteristic of the glass antenna 2 shown in FIG. 1 when the electromagnetic wave in an interval of Japan in a frequency band of 76 MHz through 90 MHz and an external of Japan in a frequency band of 88 MHz through 108 MHz for Europe or North America was as shown in FIG. 6.

If the reception gain of a standard dipole antenna is supposed to be 0 dB, a gain difference from the 0 dB standard dipole antenna (also called, a dipole ratio) was −18.3 dB in an average value in the internal of Japan frequency band and was −19.1 dB in an average value in the Europe and North America specified frequency value. These values indicated that the glass antenna 2 shown in FIG. 1 could be put into practice.

In addition, the directivity characteristic of the glass antenna 2 shown in FIG. 1 in the case where the received frequency was 80 MHz is shown in FIG. 9.

A difference in an average gain between the gain at 0° through 180° by an electromagnetic wave reception of a horizontal polarized wave and the gain at 180° through 360° by that of the horizontal polarized wave was 4.5 dB. Thus, even if the glass antenna 2 shown in FIG. 1 is attached onto one of the side windshield plate of the vehicle, the glass antenna 2 shown in FIG. 1 can favorably receive the electromagnetic wave arriving at either of the left or right side windshield at the driver's sitting seat and the passenger's sitting seat.

Furthermore, as indicated by Table 1, the improvement in the reception gain of the electromagnetic wave of 2.7 dB was obtained by adding upper and lower five horizontally extended antenna elements to the basic antenna pattern of the letter-S shaped element described in the first embodiment.

Table 1 shows the respective reception gains of the glass antenna 2 shown in FIG. 1 for the AM radio broadcasting frequency band. As shown in a sixth row ⑥ of Table 1, in a case where the other horizontally extended antenna elements 4, 4, - - - are five in the first space defined between the first horizontal wire segment 3*a*, first vertical wire segment 3*b*, and the second horizontal wire segment 3*c* of the letter-S shaped antenna element and are five in the second space defined between the second horizontal segment 3*c*, the second vertical wire segment 3*d*, and third vertical wire segment 3*e* thereof, the improvement of the reception gain described above was by +2.7 dB as compared with the reference gain of 0 dB in the case where only the letter-S shaped antenna element is attached onto the side windshield.

Second Embodiment

FIG. 2 shows the glass antenna 2 in the second embodiment which is a variation of the basic pattern shown in FIG. 1.

The respective two horizontal antenna elements 4, 4, - - - were connected to the feed terminal 1 via the first vertical wire segment 3*b* which was slightly shorter than that 3*b* shown in FIG. 1, were extended toward the opposing longitudinal side edge, and were connected to the second vertical wire segment 3*d* and extended toward the opposing side edge. In addition, the third vertical wire segment 3*f* was extended from the tip of the third horizontal wire segment 3*e* toward the first vertical wire segment 3*b*.

The two other horizontal antenna elements 4, 4, - - - were connected to the tip and midpoint of the third vertical wire segment 3*f* and extended toward the second vertical wire segment 3*d*. The tow other horizontal antenna elements 4' and 4' were extended up to the position in the proximity to the second vertical wire segment 3*d*.

This glass antenna 2 shown in FIG. 2 was printed in the screen printing using the conductive material such as the silver paste having the wire width of 0.5 millimeter through 1 millimeter before the bending process and was formed by a sintering process at the same time of the bending process.

A length of each conductive wire in the second embodiment was as follows:

A length of the first horizontal wire segment 3*a* of the letter-S shaped antenna element=450 mm.

A length of the first vertical wire segment 3*b* of the letter-S shaped antenna element=150 mm.

A length of the second horizontal wire segment 3*c* of the letter-S shaped antenna element=465 mm.

A length of the second vertical wire segment 3*d* of the letter-S shaped antenna element=250 mm.

A length of the third horizontal wire segment 3*e* of the letter-S shaped antenna element=500 mm.

A length of the third vertical wire segment 3*f* of the letter-S shaped antenna element=100 mm.

The length of each horizontal antenna element 4, 4' - - - =450 through 500 millimeters.

An interval between each horizontal antenna element 4 and 4' - - - =50 mm.

An interval between one of the horizontal antenna elements 4 and the adjacent other horizontal element 4'=50 mm.

An interval between the one of the horizontal antenna elements 4 and the first horizontal wire segment 3*a*, between the one of the horizontal antenna elements 4 and the second horizontal wire segment 3*c*, and between one of the horizontal antenna elements 4 and the third horizontal wire segment 3*e*=50 mm. An interval between the one of the horizontal antenna element 4' and the third horizontal wire segment 3*e*=50 mm.

The dimension of the inner side edge of the body flange 6 thus obtained was such that upper side A=50 mm, lower side A'=550 mm, left longitudinal side B as viewed from the passenger compartment=450 mm, and right longitudinal side B'=450 mm. The glass antenna 2 shown in FIG. 2 was attached onto the one of the side windshield sheets of the automotive vehicle.

The frequency characteristic of the glass antenna 2 shown in FIG. 2 when the electromagnetic wave in an interval of Japan in the frequency band of 76 MHz through 90 MHz and the external of Japan in the frequency band of 88 MHz through 108 MHz for Europe or North America was as shown in FIG. 7.

If the reception gain of the standard (a reference) dipole antenna is supposed to be 0 dB, a gain difference from the 0 dB standard dipole antenna (also called, the dipole ratio) was −18.3 dB in an average value in the internal of Japan frequency band and was −19.1 dB in an average value in the Europe and North America specified frequency value. These values indicated that the glass antenna 2 shown in FIG. 2 could be put into practice.

In addition, the directivity characteristic of the glass antenna 2 shown in FIG. 2 in the case where the received frequency was 80 MHz is shown in FIG. 10.

The difference in the average gain between the gain at 0° through 180° by the electromagnetic wave reception of the horizontal polarized wave and that at 180° through 360° by the electromagnetic wave reception of the horizontal polarized wave was 4.2 dB. Thus, even if the glass antenna 2 shown in FIG. 2 were attached onto one of the side windshield plate of the vehicle, the glass antenna 2 shown in FIG. 2 can favorably receive the electromagnetic wave arriving at either of the left or right side windshield at the driver's sitting seat and the passenger's sitting seat.

Third Embodiment

The third embodiment shown in FIG. 3 is a further variation of the basic pattern of the antenna elements described above in each of the first and second embodiments.

The shape of the glass sheet is of the generally triangle. The arc-shaped wire segment 3*a*' extended along the inner side edge of the body flange 6 from the feed terminal 1corresponds to the wire segment including the first horizontal wire segment 3*a* and the first horizontal wire segment 3*a* and first vertical wire segment 3*b* described in each of the first and second embodiments.

In addition, the third vertical wire segment 3*f* was extended from the tip of the third horizontal wire segment 3*e* toward the arc-shaped wire segment 3*a*' and the horizontal element 4' was connected to the feed terminal 1 via the tip of the third vertical wire segment 3*f* and was extended toward the first vertical wire segment 3*d*. The fourth vertical wire segment 3*g* was vertically extended in the upward direction from the tip of the one of the horizontal antenna elements 4 which was horizontally extended at an upper position with respect to the second horizontal wire segment 3*c* .

Then, the four horizontal antenna elements 4", 4", - - - were connected to the feed terminal 1 via the tip and midpoints of the fourth vertical wire segment 3*g* and were extended toward the arc-shaped wire segment 3*a'*.

The two horizontal antenna elements 4 and 4 branched from the second vertical wire segment 3*d* were extended in parallel to each other between the second horizontal element 3*c* and the other horizontal antenna element 4'. The other horizontal antenna element 4" was extended up to a position in proximity to the second vertical wire segment 3*d*. The four horizontal antenna elements 4", 4", - - - were extended up to a position in proximity to the arc-shaped wire segments 3*a'*.

This glass antenna 2 shown in FIG. 3 was printed in the screen printing using the conductive material such as the silver paste having the wire width of 0.5 millimeter through 1 millimeter before the bending process and was formed by the sintering process at the same time of the bending process.

A length of each conductive wire segment in the third embodiment was as follows:

A length of the second horizontal wire segment 3*c* of the letter-S shaped antenna element 3=400 mm.

A length of the second vertical wire segment 3*d* of the letter-S shaped antenna element 3=155 mm.

A length of each horizontal antenna element 4=430 through 460 mm.

A length of the horizontal antenna element 4'=490 mm.

The length of each horizontal antenna element 4"=150 through 380 millimeters.

An interval between each horizontal antenna element 4 and 4"- - - =35 mm.

An interval between the one of the horizontal antenna elements 4 and the second horizontal wire segment 3*c*, between the one of the horizontal antenna elements 4 and the one of the horizontal antenna element 4', and between the one of the horizontal antenna elements 4 and the third horizontal wire segments 3*e*=50 mm.

The dimension of the inner side edge of the body flange 6 thus obtained was lower side A'=600 mm, and left longitudinal side B as viewed from the passenger compartment=400 mm, the shape of the sheet of the side windshield being substantially right triangle. The glass antenna 2 shown in FIG. 3 was attached onto the one of the side windshield sheets of the automotive vehicle.

The frequency characteristic of the glass antenna 2 shown in FIG. 3 when the electromagnetic wave in an interval of Japan in a frequency band of 76 MHz through 90 MHz and an external of Japan in a frequency band of 88 MHz through 108 MHz specified for Europe or North America was as shown in FIG. 8.

If the reception gain of the standard (reference) dipole antenna is supposed to be 0 dB, a gain difference from the 0 dB standard dipole antenna (also called, the dipole ratio) was −18.7 dB in an average value in the internal of Japan frequency band and was −19.8 dB in an average value in the Europe and North America specified frequency value. These values indicated that the glass antenna 2 shown in FIG. 3 could be put into practice.

In addition, the directivity characteristic of the lass antenna 2 shown in FIG. 3 in the case where the received frequency was 80 MHz is shown in FIG. 11.

The difference in the average gain between that at 0° through 180° by the electromagnetic wave reception of a horizontal polarized wave and that at 180° through 360° by the electromagnetic wave reception of the horizontal polarized wave was 3.7 dB. Thus, even if the glass antenna 2 shown in FIG. 3 is attached onto one of the side windshield plates of the vehicle, the glass antenna 2 shown in FIG. 3 can favorably receive the electromagnetic wave arriving at either of the left or right side windshield at the driver's sitting seat and the passenger's sitting seat.

The entire contents of Japanese Patent Application No. Heisei 11-349585 filed in Japan on Nov. 12, 1999 are herein incorporated by reference. Although the invention has been described above by reference to certain embodiment of the invention, the invention is not limited to the embodiments described above. Modifications and variations of the embodiments described above will occur to those skilled in the art in the light of the above teachings. The scope of the invention is defined with reference to the following claims.

TABLE 1

| PROFILE OF ANTENNA | RECEPTION GAIN OF AM FREQUENCY BAND |
|---|---|
| ① ONLY LETTER-S SHAPED ELEMENT | 0 dB (REFERENCE) |
| ② LETTER-S SHAPED ELEMENT + UPPER MOST AND LOWER MOST HORIZONTAL ELEMENTS | +1.1 dB |
| ③ LETTER-S SHAPED ELEMENT + TWO UPPER AND LOWER HORIZONTAL ELEMENTS | +1.8 dB |
| ④ LETTER-S SHAPED ELEMENT + THREE UPPER AND LOWER HORIZONTAL ELEMENTS | +2.3 dB |
| ⑤ LETTER-S SHAPED ELEMENT + FOUR UPPER AND LOWER HORIZONTAL ELEMENTS | +2.6 dB |
| ⑥ LETTER-S SHAPED ELEMENT + FIVE UPPER AND LOWER HORIZONTAL ELEMENTS | +2.7 dB |

THE NUMBER OF UPPER AND LOWER HORIZONTAL ELEMENTS MEANS THE NUMBER OF HORIZONTAL ELEMENTS CONNECTED TO THE FIRST VERTICAL LINE SEGMENT AND THE SECOND VERTICAL LINE SEGMENT IN THE LETTER-S SHAPED ELEMENT

What is claimed is:

1. A glass antenna for a windshield for an automotive vehicle, comprising:

a feed terminal disposed on a proximity to a first corner of the windshield;

a substantially letter-S shaped antenna element, the letter-S shaped antenna element comprising: a first wire segment extended from the feed terminal at the proximity to the first corner toward a substantially opposite direction to the first corner along at least a first side edge of the windshield; a second wire segment extended from a tip of the first wire segment toward a proximity to a center of a second side edge of the windshield; a third wire segment extended from a tip of the second wire segment toward a proximity to a second corner of the windshield which is opposite to the first corner; and a fourth wire segment extended from a tip of the third wire segment toward a substantially opposite direction to the second corner a long a third side edge of the windshield; and a plurality of other antenna elements, the other antenna elements being connected to the feed terminal, extended in parallel to one another and in parallel to at least one of the first and third side edges of the windshield, and being intersected across a first space and a second space, respectively, so as to fill each of the first space and the second space, the first space and second space being defined by the wire segments constituting the substantially letter-S shaped antenna element.

2. A glass antenna for a windshield for an automotive vehicle as claimed in claim 1, wherein the first wire segment of the letter-S shaped antenna element comprises a fifth wire segment extended from the feed terminal toward a fourth corner of the windshield which is opposite to the first corner along the first side edge and a sixth wire segment extended from a tip of the fifth wire segment toward the proximity to the center of a fourth side edge of the windshield.

3. A glass antenna for a windshield for an automotive vehicle as claimed in claim 2, wherein the other antenna elements extended in the first space and in the second space are connected to the feed terminal via the sixth wire segment and via the third wire segment, respectively.

4. A glass antenna for a windshield for an automotive vehicle as claimed in claim 3, wherein the substantially S-shaped antenna element further comprises a seventh wire segment at the proximity to the third corner toward a midway through the proximity to the center of the fourth side edge, at least one of the other antenna elements extended in the second space being connected to the feed terminal via the seventh wire segment.

5. A glass antenna for a windshield for an automotive vehicle as claimed in claim 4, further comprising a first auxiliary antenna element extended from the feed terminal toward a midway through the proximity to the center of the second side edge of the windshield.

6. A glass antenna for a windshield for an automotive vehicle as claimed in claim 1, further comprising an eighth wire segment extended from a tip of one of the other antenna elements extended in the first space toward the proximity to the feed terminal, the other antenna elements extended in the first space being connected to the feed terminal via the eighth wire segment; and a ninth wire segment extended from a tip of the fourth wire element toward a midway through the proximity to the center of the first side edge, one of the other antenna elements extended in the second space being connected to the feed terminal via the ninth wire segment and the other antenna element extended in the second space being connected to the feed terminal via the third wire segment.

7. A glass antenna for a windshield for an automotive vehicle as claimed in claim 6, further comprising a second auxiliary element extended from the e feed terminal toward a midway through the proximity to the center of the first side edge along the first wire segment.

8. A glass antenna for a windshield for an automotive vehicle as claimed in claim 4, wherein the windshield comprises a side windshield having a substantial shape of a parallelogram.

9. A glass antenna for a windshield for an automotive vehicle as claimed in claim 6, wherein the windshield comprises a side windshield having a substantial shape of a right triangle.

10. A glass antenna for a windshield for an automotive vehicle as claimed in claim 9, wherein the windshield is of a substantially arc shape along the first side edge of the side windshield.

11. A glass antenna for a windshield for an automotive vehicle as claimed in claim 3, wherein each spatial interval between the other antenna elements including the second wire segment ranges from 20 millimeters to 100 millimeters.

12. A glass antenna for a windshield for an automotive vehicle as claimed in claim 3, wherein a width of each of the wire segments and the other antenna elements which are made of conductive strips ranges from 0.5 millimeters to 1 millimeter.

13. A glass antenna for a side windshield of an automotive vehicle, the side windshield comprising a general shape of a parallelogram and the glass antenna comprising:

a feed terminal disposed on a proximity to a first corner of the side windshield;

a substantially letter-S shaped antenna element, the substantially letter-S shaped antenna element comprising: a first horizontal wire segment extended from the feed terminal toward a horizontally opposite direction to the first corner along a first side edge of the side windshield; a first vertical wire segment extended from a tip of the first horizontal wire segment toward a proximity to a center of a second side edge of the side windshield; a second horizontal wire segment extended horizontally from a tip of the first vertical wire segment toward a proximity to a center of a third side edge of the side windshield which is opposite to the proximity to the center of the second side edge thereof; a second vertical wire segment extended vertically from a tip of the second horizontal wire segment toward a proximity to a second corner of the side windshield; and a third horizontal wire segment extended from a tip of the second vertical wire segment toward a proximity to a third corner of the side windshield; and a plurality of other antenna horizontal elements connected to the feed terminal, extended in parallel to one another and in parallel to the first edge of the windshield, and intersected across a first space defined between the first horizontal and first vertical wire segments and the second horizontal wire segment so as to fill the first space and across a second space defined between the second horizontal, the second vertical, and the third horizontal wire segments so as to fill the second space.

14. A glass antenna for a side windshield of an automotive vehicle as claimed in claim 13, further comprising a third vertical wire segment extended vertically from a tip of the third horizontal wire segment toward a midway through the proximity to the center of the second side edge of the side windshield and wherein the other antenna horizontal elements extended in the first space are connected to the feed terminal via the first vertical wire segment and two of the other antenna horizontal elements extended in the second space are connected to the feed terminal via the third vertical wire segment and the remaining other antenna elements extended in the second space are connected to the feed terminal via the second vertical wire segment.

15. A glass antenna for a side windshield of an automotive vehicle as claimed in claim 14, further comprising a first auxiliary antenna element extended vertically from the feed terminal toward a proximity to the tip of the second horizontal wire segment.

16. A glass antenna for a side windshield of an automotive vehicle, the side windshield comprising a general shape of a right triangle and the glass antenna comprising:

a feed terminal disposed on a proximity to a first corner of the side windshield;

a substantially letter-S shaped antenna element comprising: a first arc-shaped wire segment extended from the feed terminal toward a substantially horizontally opposite direction to the first corner along a side edge faced toward a body flange and toward a proximity to a center of the side edge; a second horizontal wire segment extended horizontally from a tip of the arc-shaped wire segment toward a proximity to a center of another side edge of the side windshield which is opposite to the proximity to the body flange; and a second vertical wire segment extended vertically from a tip of the second horizontal wire segment toward a proximity to a second corner of the side windshield; and a third horizontal wire segment extended from a tip of the second vertical wire segment toward a substantially opposite direction to the second corner of the side windshield; and a plurality of other antenna horizontal elements connected to the feed terminal and extended in parallel to one another in a first space defined between the first arc-shaped and second horizontal wire segments and in a second space defined between the second horizontal wire segment, the second vertical wire segment, and the third horizontal wire segment.

17. A glass antenna for a side windshield of an automotive vehicle as claimed in claim 16, further comprising a second arc-shaped wire segment extended from a tip of the third horizontal wire segment toward a midway through the proximity to the center of the body flange and a third vertical wire segment extended from a tip of one of the other antenna horizontal elements extended in the first space toward the proximity to the feed terminal and wherein at least one of the other antenna elements extended in the second space is connected to the feed terminal via the second arc-shaped wire segment and the remaining other antenna horizontal elements extended in the second space are connected to the feed terminal via the second vertical wire segment.

18. A glass antenna for a side windshield of an automotive vehicle as claimed in claim 17, further comprising a second auxiliary antenna element extended from the feed terminal along the first arc-shaped wire segment.

* * * * *